US005581847A

United States Patent [19]

Hsieh

[11] Patent Number: 5,581,847

[45] Date of Patent: Dec. 10, 1996

[54] HANDLE DEVICE OF A WHEELED TRUNK EXTENSIBLE AND RETRACTABLE BY A SINGLE HAND

[76] Inventor: Dick M. Hsieh, No. 18, Lane 777, Chung-Shan Rd., Kuei-Jen Hsiang, Tainan Hsien, Taiwan

[21] Appl. No.: 494,347

[22] Filed: Jun. 26, 1995

[51] Int. Cl.[6] ..... A45C 3/00; B62B 3/02; B62B 1/12

[52] U.S. Cl. ..... 16/115; 190/39; 190/115; 190/117; 280/655.1; 280/47.26; 280/47.315

[58] Field of Search ..... 16/115; 280/37, 280/655, 655.1, 47.26, 47.315; 190/39, 115, 117

[56] References Cited

U.S. PATENT DOCUMENTS

| | | | |
|---|---|---|---|
| 2,989,968 | 6/1961 | Vogel | 16/115 |
| 3,366,406 | 1/1968 | Morris | 16/115 |
| 3,811,455 | 5/1974 | Thur | 16/115 |
| 5,207,440 | 5/1993 | Liang | 280/37 |
| 5,407,040 | 4/1995 | Hu | 16/115 |
| 5,431,428 | 7/1995 | Marchwiak et al. | 280/47.315 |

*Primary Examiner*—M. Rachuba

*Assistant Examiner*—Donald M. Gurley

*Attorney, Agent, or Firm*—Ladas & Parry

[57] ABSTRACT

A handle device of a wheeled trunk includes an elongated frame member mounted on a side wall of the trunk, and a handle member mounted telescopically in the frame member. The frame member has an opening formed through an upper portion thereof, and a receiving space formed in the frame member in communication with the opening. The handle member includes a handle exposed to an exterior of the frame member, an elongated unitary plate connected securely to the handle and inserted movably into the receiving space of the frame member, a spring-loaded upper push button installed to an upper portion of the unitary plate and engaged within the opening of the frame member to prevent movement of the unitary plate in the receiving space, thus locating the handle member at a retracted position relative to the frame member, and a spring-loaded lower push button installed on a lower portion of the unitary plate. Upon pressing and disengaging the upper push button from the opening, the handle member can be moved to an extended position, wherein the lower push button engages the opening of the frame member. A press on the lower push button withdraws the handle member into the retracted position due to gravity action.

3 Claims, 8 Drawing Sheets

HANDLE DEVICE OF A WHEELED TRUNK EXTENSIBLE AND RETRACTABLE BY A SINGLE HAND

BACKGROUND OF THE INVENTION

1. Field of the Invention

The invention relates to a handle device, more particularly to an extensible and retractable handle device for a wheeled trunk.

2. Description of the Related Art

Referring to FIGS. 1 and 2, a wheeled trunk 1 has a conventional retractable handle device (B) installed on a side wall 11 of the trunk 1. As illustrated, the conventional handle device (B) includes a frame member 12, a handle member 13 and a locking mechanism 14. The frame member 12 is mounted on the side wall 11 of the trunk 1 and includes a pair of vertically extending storage tubes 131, each of which has an open top end 1311 and a hole 1312 adjacent to the top end 1311. The handle member 13 is U-shaped and has two parallel arm portions 132 inserted downwardly and slidably into the top ends 1311 of the storage tubes 131. An engaging device (not shown) interconnects the storage tubes 131 and the parallel arm portions 132 and thus prevents disengagement of the arm portions 132 from the storage tubes 131. The parallel arm portions 132 can be pulled out from the storage tubes 131 so as to be located at the fully extended position. Each of the parallel arm portions 132 has a vertical row of holes 134 formed therethrough. The arm portions 132 can be moved within the storage tubes 131 so as to align the holes 1312 of the storage tubes 131 with a selected pair of holes 134 of the arm portion 132, thereby permitting the locking mechanism 14 to lock the arm portions 132 on the storage tubes 131.

The locking mechanism 14 is mounted on the frame member 12 between the storage tubes 131 and includes a pair of spring-loaded projection members 15, each of which has a projection 151 that extends into the first hole 1312 of the respective storage tube 131 at normal condition. When the arm portions 132 are moved within the storage tubes 131 so as to align a selected pair of holes 134 with the holes 1312 of the storage tube 131, the projections 151 are biased by the spring action to extend into the holes 134 of the arm portions 132 via the holes 1312. When desired, the spring-loaded projection members 15 can be operated by two fingers of a hand in the openings 121 which are formed through the frame member 12 so as to disengage the projections 151 from the holes 134, 1312.

Note that the length of the handle member 13 cannot be adjusted by the use of a single hand. When one wishes to extend the handle member 13 to a desired length, one hand must operate the locking mechanism 14 to disengage the projections 151 from the holes 134, 1312, while the other hand must pull the handle member 13 out from the storage tubes 131. This is inconvenient to the user, especially when one of his or her hands is carrying an article.

SUMMARY OF THE INVENTION

The main object of the present invention is to provide an extensible and retractable handle device for a wheeled trunk which can be operated by the use of a single hand so as to extend or retract a handle member.

Accordingly, the handle device of the present invention includes an elongated frame member and a handle member. The frame member is adapted to be secured on a side wall of a wheeled trunk and has an upper portion with an opening formed therethrough, and a lengthwise extending receiving space which is formed in the frame member and which is in communication with the opening. The handle member is mounted telescopically in the frame member and includes a handle which is exposed to an exterior of the frame member, an elongated unitary plate which is connected securely with the handle and which is inserted downwardly and movably into the receiving space of the frame member, a spring-loaded upper push button which is installed to an upper portion of the unitary plate and which is engaged within the opening of the frame member so as to prevent movement of the unitary plate in the receiving space and so as to retain the handle member in a retracted position relative to the frame member, and a spring-loaded lower push button which is installed on a lower portion of the unitary plate and which is spaced apart from the upper press button.

When pressing and disengaging the upper push button from the opening by a thumb of a hand, while pulling the handle member upward the remaining four fingers of the hand, the handle member of the handle device of the present invention can be pulled from the retracted position to an extended position relative to the frame member such that the lower push button engages the opening of the frame member, thereby positioning the handle member at the extended position.

When it is desired to retract the handle member into the frame member, the user only needs to press and disengage the lower push button from the opening so that the lower portion of the unitary plate withdraws into the receiving space of the frame member by virtue of gravity.

BRIEF DESCRIPTION OF THE DRAWINGS

Other features and advantages of the present invention will become more apparent in the following detailed description of the preferred embodiment with reference to the accompanying drawings, in which.

DETAILED DESCRIPTION OF THE PREFERRED EMBODIMENT

Figure 1:
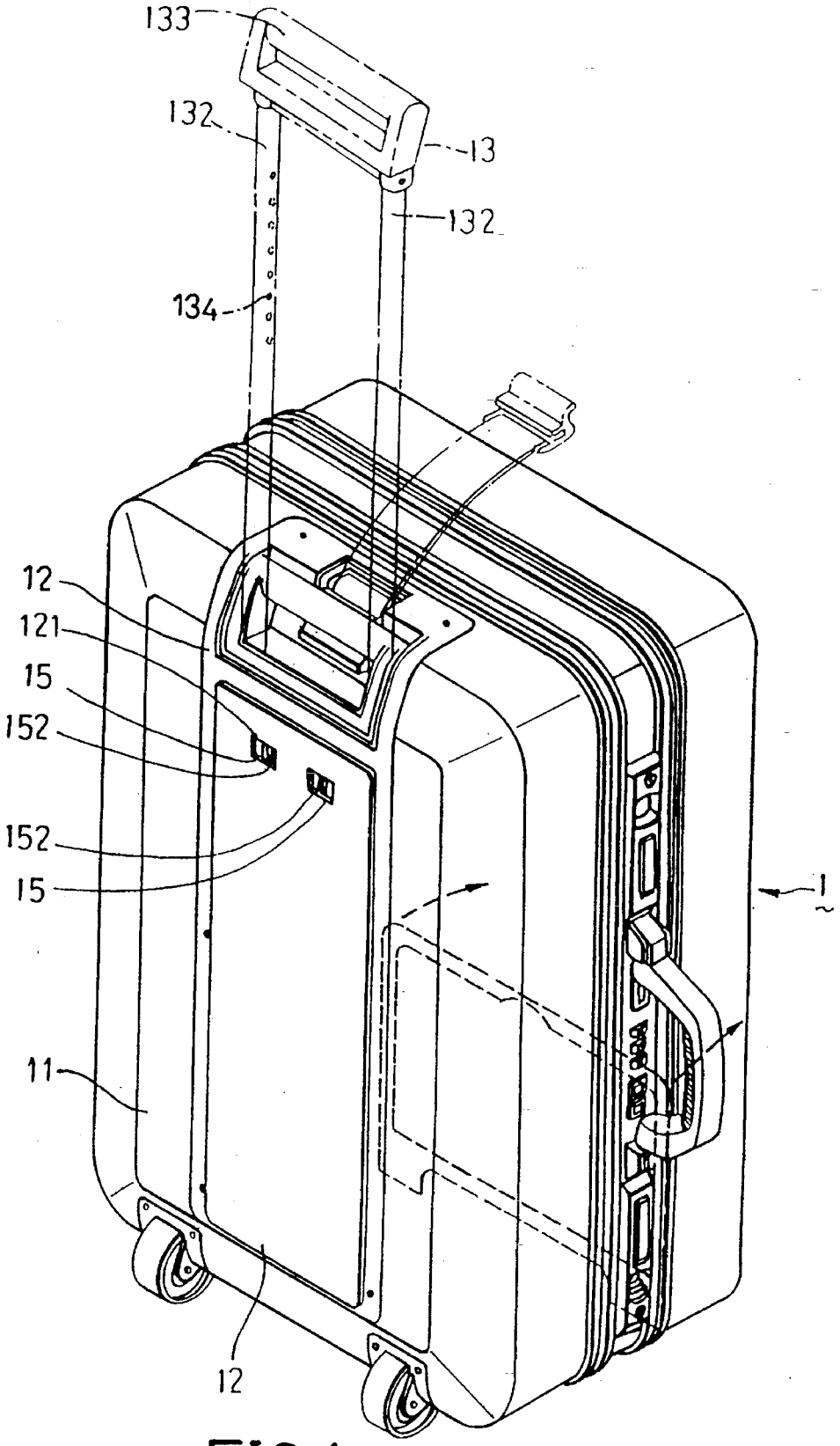
FIG.1 PRIOR ART
FIG. 1 is a perspective view of a wheeled trunk provided with a conventional retractable handle device.
Figure 2:
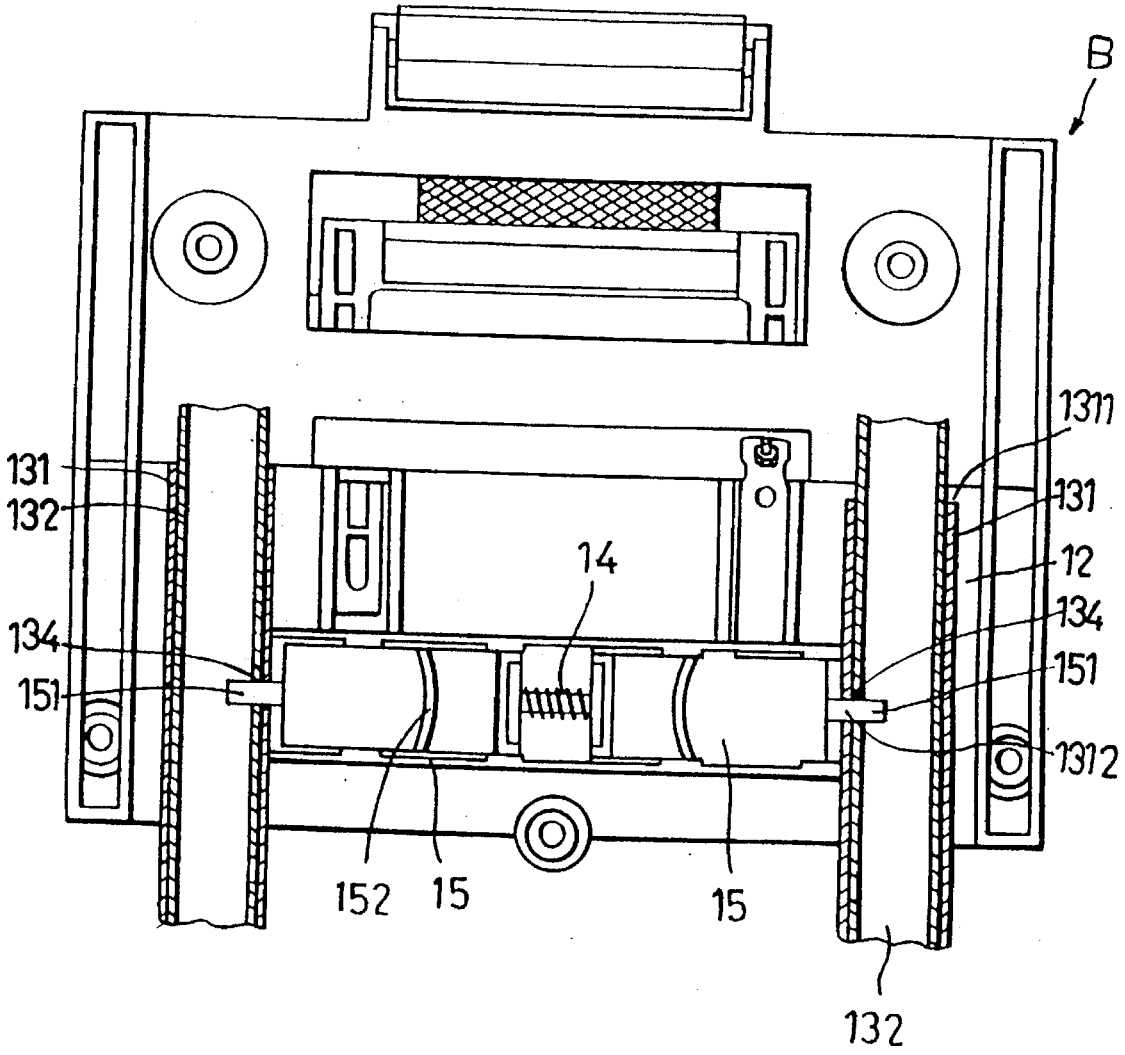
FIG.2 PRIOR ART
FIG. 2 is a sectional view of the conventional handle device.
Figure 3:
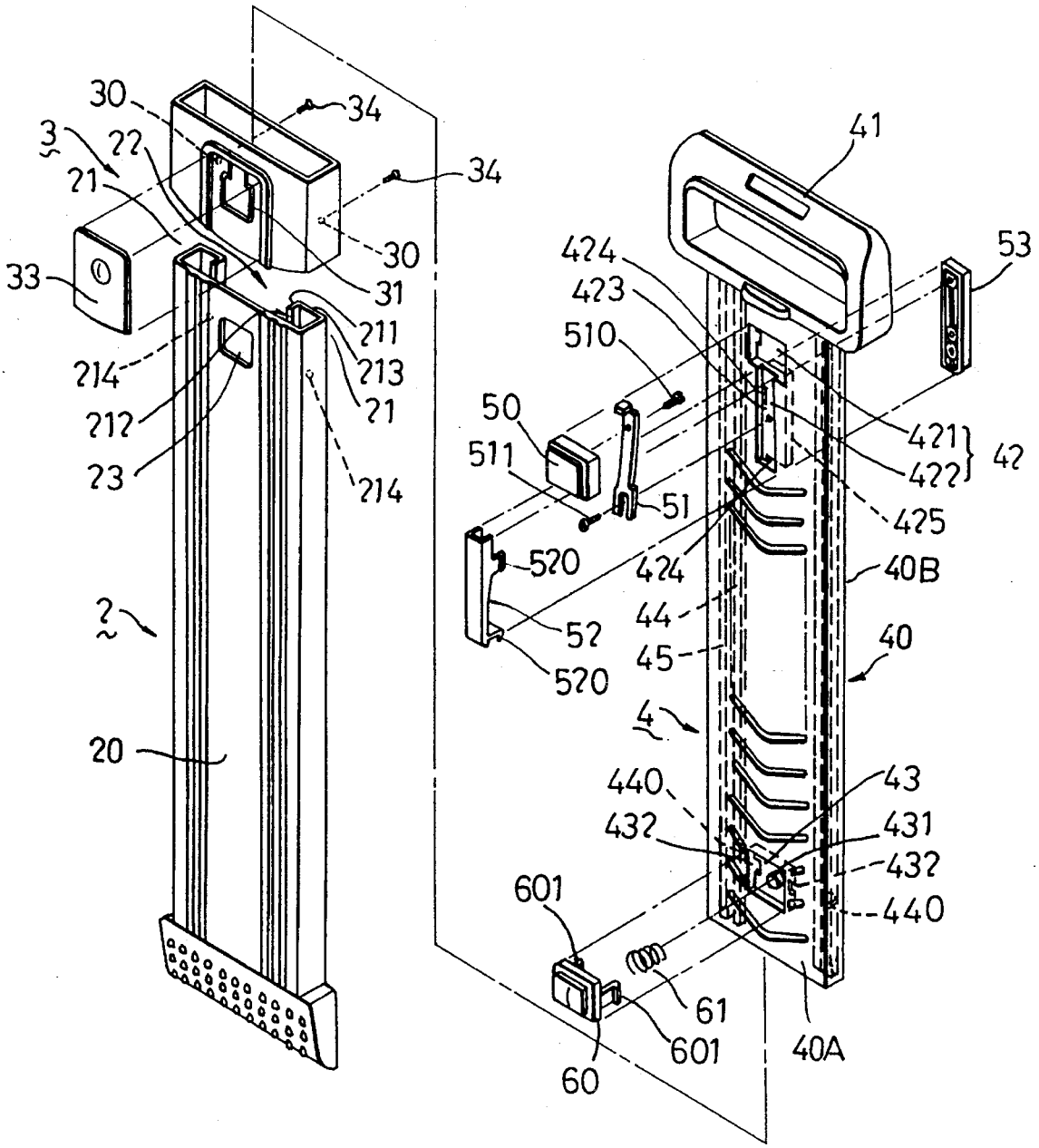
FIG. 3 is an exploded view of a handle device of the present invention which is to be mounted on a side wall of a wheeled trunk.
Figure 4:
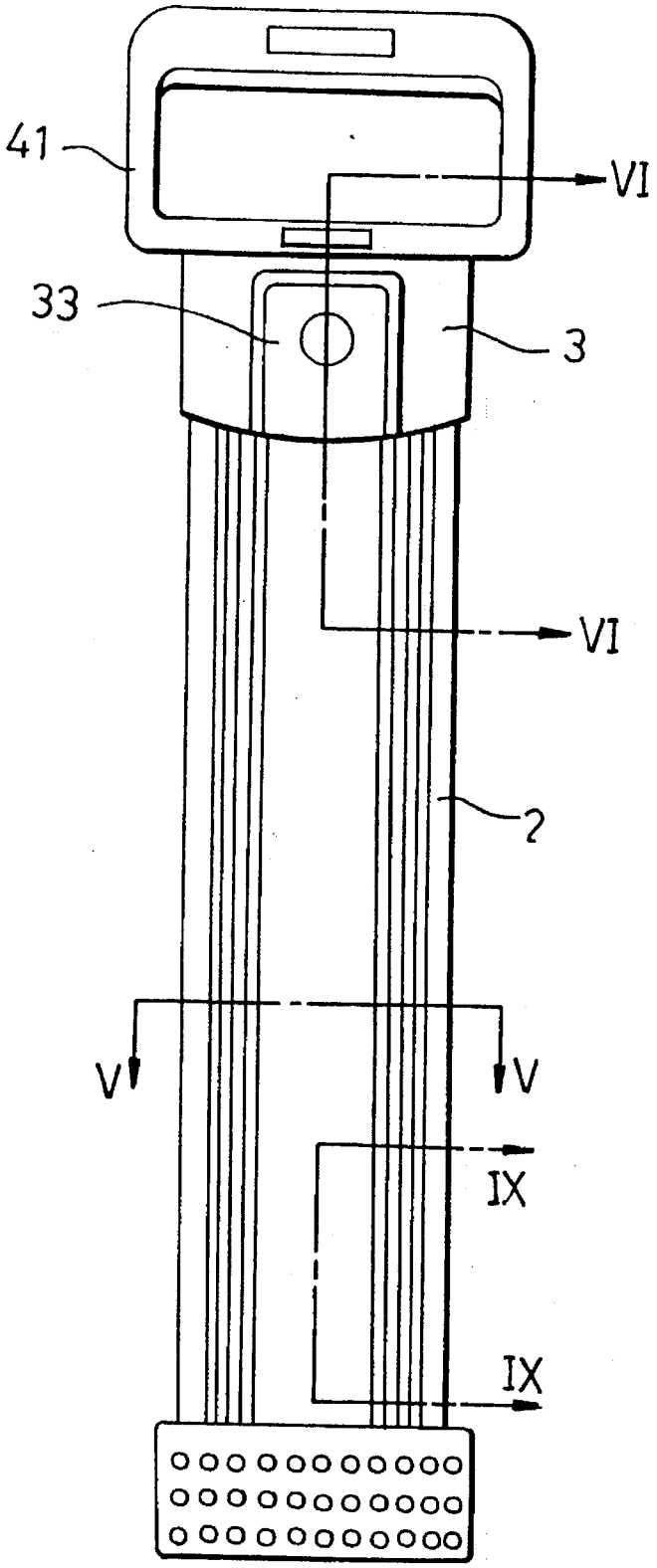
FIG. 4 is an elevational view of the handle device of the present invention.

A handle device of the present invention is adapted to be mounted on a side wall of a wheeled trunk. As illustrated in FIGS. 3 and 4, the handle device includes an elongated frame member 2, an oblong sleeve 3, and a handle member 4. The frame member 2 includes an elongated flat plate 20 and a pair of spaced parallel sliding sheets 21 which are integrally formed with the flat plate 20. Each of the sliding sheets 21 has a longitudinal flange 211 which is spaced from the flat plate 20. The frame member 2 further has a lengthwise extending receiving space 22 defined between the sliding sheets 21, and an opening 23 formed through the upper end portion thereof in communication with the receiving space 22.

The oblong sleeve 3 is sleeved on the upper end portion of the frame member 2 and includes an inverted T-shaped opening 31 which is formed through a wall portion thereof and which is aligned with the opening 23 of the frame member 2. A flexible thin press member 33 is press-fitted in the sleeve 3 and covers the opening 31.

Figure 5:
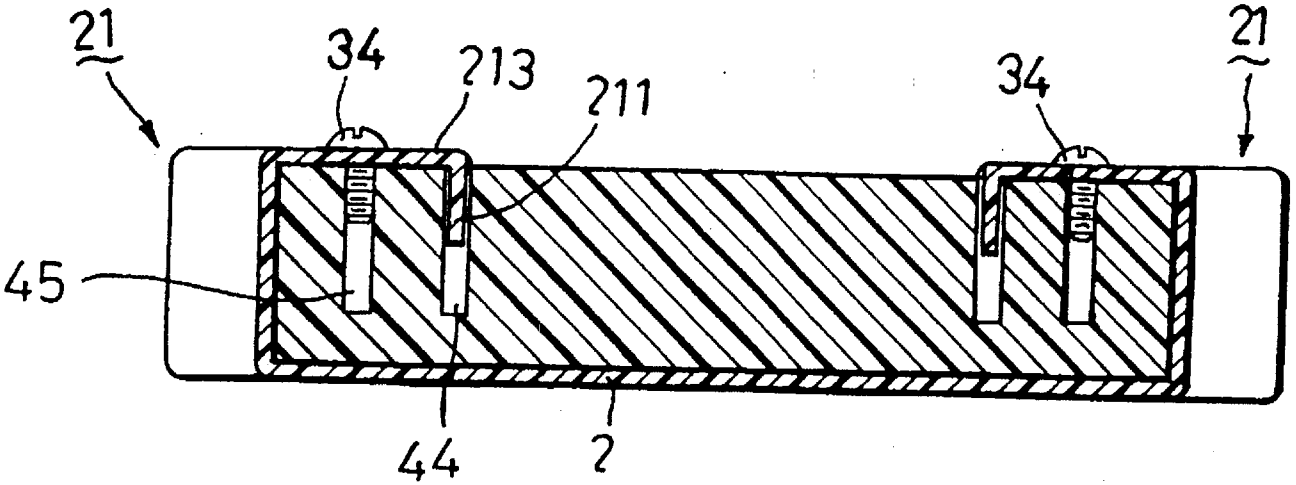
FIG. 5 is a sectional view of the handle device of the present invention taken along line V—V in FIG. 4.

The handle member 4 is mounted telescopically in the frame member 2 and includes a looped handle 41 exposed to an exterior of the frame member 2, and an elongated straight unitary plate 40 connected securely to the lower end of the handle 41 and inserted downwardly and movably into the receiving space 22 of the frame member 2. The unitary plate 40 has a first surface 40A which is formed with an upper chamber 42 and a lower chamber 43, and a second surface 40B which has a pair of lengthwise extending guiding slots 44 that receive slidably the longitudinal flanges 211 of the sliding sheets 21 (see FIG. 5), and a pair of lengthwise extending retaining slots 45 respectively adjacent to the guiding slots 44. As best illustrated in FIG. 5, a pair of retaining bolts 34 extend through the threaded holes 30 (see FIG. 3) of the sleeve 3 and the threaded holes 214 of the wall portions 213 of the frame member 2 and respectively extend into the retaining slots 45 of the unitary plate 40. The unitary plate 40 has two stop elements 440 which are respectively secured in the lower end portions of the retaining slots 45.

Figure 6:
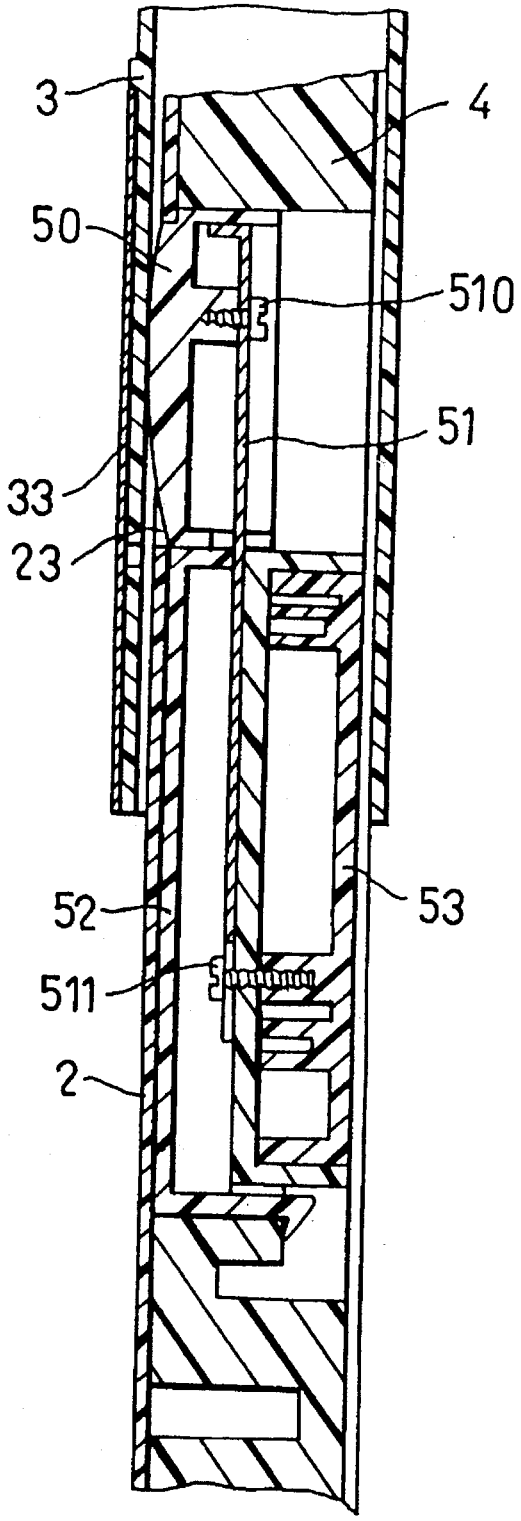
FIG. 6 is a sectional view of the handle device taken along line VI—VI in FIG. 4, illustrating how a handle member is located at a retracted position relative to a frame member.

The upper chamber 42 is generally T-shaped and has an rectangular upper section 421 and a vertical lower section 422. The vertical lower section 422 is defined by a bottom wall which has an upper end portion 423 through two sides of which two orifices 424 (only one is shown in FIG. 3) are respectively formed, and a lower end portion with an orifice 424 formed therethrough. The second surface 40B of the unitary plate 40 has a recess 425 formed therein and aligned with the lower section 422 of the upper chamber 42. A curved and elongated spring sheet 51 is fastened to the unitary plate 40 by a screw 511. An upper push button 50 is fastened to the spring 51 by a screw 510. A cover member 52 has three barbs 520 which are engaged within the orifices 424 of the unitary plate 40 so as to cover the lower section 422 of the upper chamber 42. A cover 53 is screwed to the plate 40 so as to cover the recess 425. Accordingly, the spring 51 biases the upper push button 50 to engage the opening 23 of the frame member 2 so as to prevent movement of the unitary plate 40 in the receiving space 22, as shown in FIG. 6, thereby keeping the handle member 4 at a retracted position relative to the frame member 2, as best shown in FIG. 4.

Figure 9:
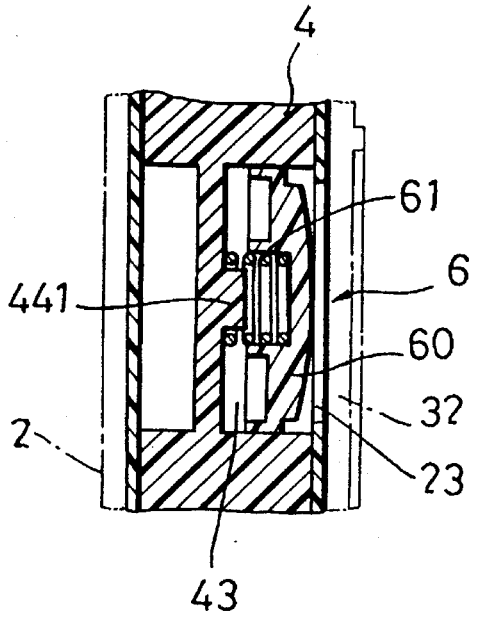
FIG. 9 is a sectional view of the handle device of the present invention taken along line IX—IX in FIG. 4.

The unitary plate 40 further includes a positioning post 431 on which a coiled compression spring 61 is sleeved. The lower chamber 43 is defined by a bottom wall through which two orifices 432 are formed. A lower push button 60 is provided with two side barbs 601 which extend through the orifices 432 of the unitary plate 40 so as to secure the lower push button 60 to the unitary plate 40. When the handle member 4 is at the retracted position, the spring 60 is compressed by the flat plate 20 of the frame member 2, as shown by the dotted lines in FIG. 9.

Figure 7:
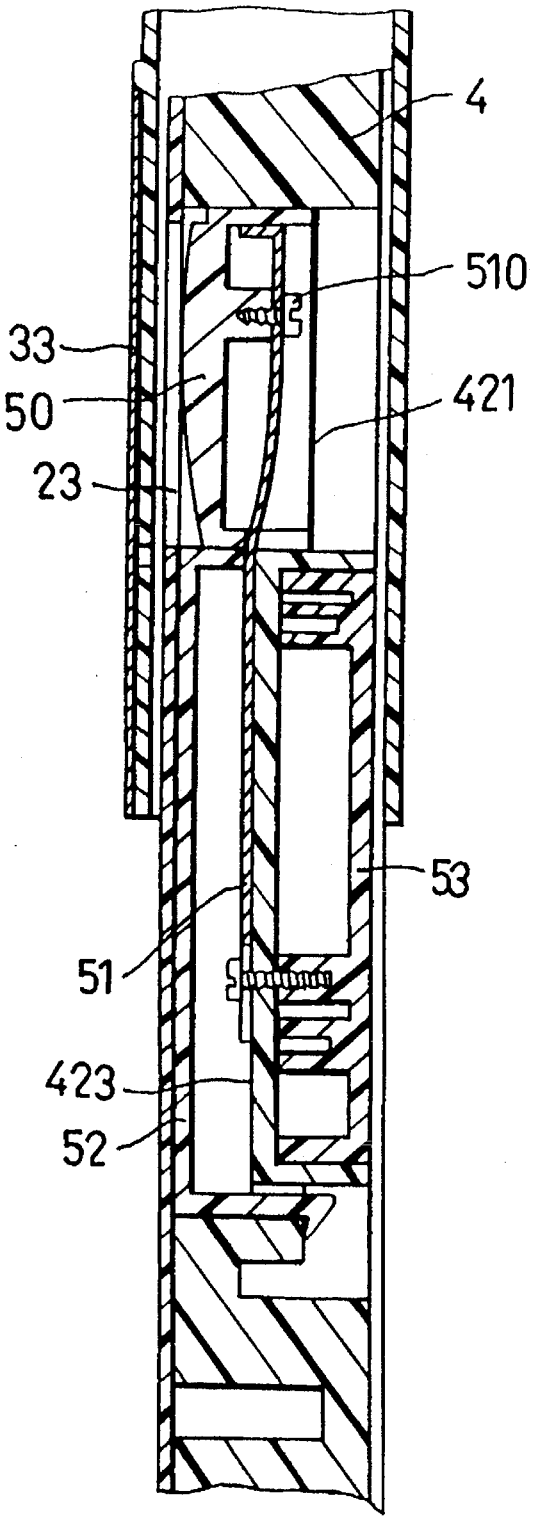
FIG. 7 is a sectional view, illustrating how the handle device of the present invention is operated so as to permit movement of the handle member in the frame member.
Figure 8:
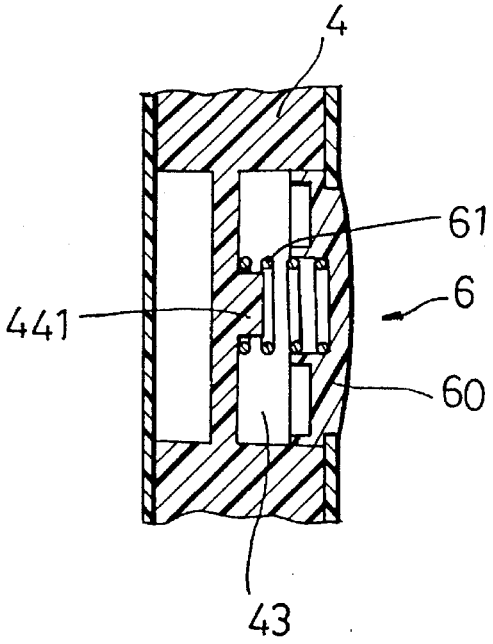
FIG. 8 is a sectional view illustrating how the handle member of the handle device according to the present invention is located at an extended position in the frame member.

When it is desired to move the unitary plate 40 of the handle member 4 upward relative to the frame member 2, the push button 50 is pressed by a thumb of one hand of the user, and the looped handle 41 is pulled upward by the remaining four fingers of the hand so as to disengage the upper push button 50 from the opening 23 of the frame member 2, as shown in FIG. 7. When the lower push button 60 is moved to the extended position shown in FIG. 8, the lower push button 60 is no longer compressed by the frame member 2 and is biased by the spring 61 to engage the opening 23 of the frame member 2.

When the handle member 4 is located at the extended position, the retaining bolts 34 contact the stop elements 440 of the unitary plate 40 so as to prevent upward removal of the handle member 4 from the frame member 2. When desired, a press on the lower push button 60 withdraws the unitary plate 40 into the receiving space 22 of the frame member 2 by virtue of gravity.

With the present invention thus explained, it is obvious to those skilled in the art that various modifications and variations can be made without departing from the scope and spirit thereof. It is therefore intended that the invention to be limited only as in the appended claims.

I claim:

1. A handle device for a wheeled trunk, comprising:

an elongated frame member having flanged edges, the frame member being adapted to be secured on a side wall of said trunk and having an upper portion and an opening formed through said upper portion, and a lengthwise extending elongated receiving space formed in said frame member and flanged edges in communication with said opening; and a handle member mounted telescopically in said frame member and including a handle exposed to an exterior of said frame member, an elongated unitary plate connected to a lower portion of said handle and inserted downwardly and movably into said receiving space of said frame member between the flanged edges thereof, a spring-loaded upper push button installed to an upper portion of said unitary plate and engaged within said opening of said frame member so as to prevent movement of said unitary plate in said receiving space and so as to retain said handle member at a retracted position relative to said frame member, and a spring-loaded lower push button installed on a lower portion of said unitary plate and spaced apart from said upper push button;

said unitary plate of said handle member being capable of being moved upward in said receiving space of said frame member from said retracted position to an extended position relative to said frame member upon pressing and disengaging said upper push button from said opening and upon upward pulling of said handle so as to engage said lower push button within said opening of said frame member.

2. A handle device as defined in claim 1, wherein said unitary plate of said handle member is straight and has a pair of lengthwise extending guiding slots respectively formed in two side portions of a surface thereof, and a pair of lengthwise extending retaining slots respectively formed in said two side portions of said surface of said unitary plate, said frame member including an elongated flat plate, and a pair of spaced parallel sliding sheets which are secured on said flat plate, and which are respectively and slidably engaged within said guiding slots of said unitary plate.

3. A handle device as defined in claim 2, further comprising a pair of retaining bolts which are connected respectively and securely to said frame member and which respectively extend into said retaining slots of said unitary plate, said unitary plate further including two stop elements respectively fixed in lower portions of said slots, whereby when said unitary plate is moved upward in said receiving space from said extended position, said retaining bolts contact said stop elements so as to prevent upward removal of said handle member from said frame member.

* * * * *